US006553702B1

(12) United States Patent
Bacnik

(10) Patent No.: US 6,553,702 B1
(45) Date of Patent: Apr. 29, 2003

(54) HOLDER FOR AN ELECTRONIC PRICE LABEL

(75) Inventor: James A. Bacnik, Mentor, OH (US)

(73) Assignee: Fasteners For Retail, Inc., Cleveland, OH (US)

( * ) Notice: Subject to any disclaimer, the term of this patent is extended or adjusted under 35 U.S.C. 154(b) by 0 days.

(21) Appl. No.: 09/518,407

(22) Filed: Mar. 3, 2000

Related U.S. Application Data

(60) Provisional application No. 60/123,107, filed on Mar. 5, 1999.

(51) Int. Cl.[7] ..... G09F 3/18

(52) U.S. Cl. ..... 40/661.03; 40/649

(58) Field of Search ..... 40/661.03, 649, 40/651, 650

(56) References Cited

U.S. PATENT DOCUMENTS

| | | | | | |
|---|---|---|---|---|---|
| 4,532,726 | A | * | 8/1985 | Kenney | 40/650 |
| 5,375,357 | A | | 12/1994 | Butcher et al. | |
| 5,473,833 | A | | 12/1995 | Ostrovsky | |
| 5,553,412 | A | | 9/1996 | Briechle et al. | |
| 5,575,100 | A | | 11/1996 | Marvin et al. | |
| 5,611,512 | A | | 3/1997 | Cholet | |
| 5,715,622 | A | | 2/1998 | Giordano, Jr. | |
| 5,791,080 | A | | 8/1998 | Hamano | |
| 5,816,550 | A | | 10/1998 | Watanabe et al. | |
| 5,899,011 | A | | 5/1999 | Brinkman | |
| 6,035,569 | A | * | 3/2000 | Nagel | 40/661.03 |

FOREIGN PATENT DOCUMENTS

WO 93/19448 9/1993

OTHER PUBLICATIONS

FFR 1999 Yellow Pages Catalogue, Cover Page, p. 4a, "Protective Shelf Channel Sign Holders" page, and pp. 31, 41–43, 52, 63–65, 68–69.
EZ–View 1998 Catalog, vol. 2, p. 20.
EZ–View Catalog, p. 11.
FFR 1997 Buyers Guide, pp. 22–23, 32, 35–38, 68 and 73.
HL Display 1995 Catalog, pp. 36–41.

* cited by examiner

*Primary Examiner*—Cassandra H. Davis
(74) *Attorney, Agent, or Firm*—Fay, Sharpe, Fagan, Minnich & McKee, LLP

(57) ABSTRACT

An extruded holder for an electronic price label (EPL) includes a channel member defined by a base wall and first and second spaced-apart sidewalls that project outwardly from opposite ends of the base wall with respective first and second inner faces arranged in opposed facing relation. The base wall and the sidewalls define a C-shaped recess in the channel member. The sidewall inner faces each define a groove that extends parallel to the base wall, and an associated EPL is adapted for receipt in the recess with first and second projections of the EPL respectively positioned in the first and second grooves. A clip is connected to the channel member and is adapted for releasable connection to a wide variety of different retail shelf fixtures. The clip is defined by a base member and a back member interconnected to define an L-shaped cross-sectional shape, and the clip is further defined by a connecting arm that has a first end connected to the clip base member and a second end connected to the channel member. The connecting arm and the clip back member define a slot therebetween that receives and retains a projecting edge of an associated retail shelf. In an alternative embodiment, the channel member includes an adhesive mounting portion connected thereto that is adapted for adhesive securement to an associated retail shelf or to an adapter that is, in turn, connected to the retail shelf, a wire basket, or other retail fixture.

19 Claims, 10 Drawing Sheets

512

HOLDER FOR AN ELECTRONIC PRICE LABEL

CROSS-REFERENCE TO RELATED APPLICATION

This application claims priority from U.S. Provisional Application Ser. No. 60/123,107 filed Mar. 5, 1999 which is also hereby expressly incorporated by reference herein.

BACKGROUND OF THE INVENTION

The present invention relates to a holder for an electronic price label (EPL) and, more particularly, a holder for an EPL which is cost-effective, convenient to manufacture, and adapted for secure attachment to a wide variety of retail shelving in a manner which facilitates convenient viewing of an associated EPL.

EPL's and holders therefore are widely known. They are described, for example, in U.S. Pat. Nos.: 5,553,412; 5,791,080; 5,816,550; and 5,611,512. However, prior holders for EPL's have been found to be deficient for a wide variety of reasons. Some are simply too complicated and, consequently, expensive and difficult to manufacture. Others are not well-suited for connection to a wide variety of different shelving types as are commonly found in the retail industry and/or require use of separate fasteners. Still others are prone to becoming dislodged when inadvertently contacted by consumers and others. For these and other reasons, there exists a need for a new and improved holder for an EPL which is convenient to manufacture, cost-effective, suitable for use with a large number of different types of retail shelving, and which securely affixes an associated EPL in a desired location relative to a retail shelf without use of fasteners and in a manner which facilitates EPL viewing but resists dislodgement due to inadvertent contact.

SUMMARY OF THE INVENTION

In accordance with the present invention, an extruded holder for an electronic price label (EPL) includes a channel member defined by a base wall and first and second spaced-apart sidewalls that project outwardly from opposite ends of the base wall with respective first and second inner faces arranged in opposed facing relation. The base wall and the sidewalls define a C-shaped recess in the channel member. The sidewall inner faces each define a groove that extends parallel to the base wall, and an associated EPL is adapted for receipt in the recess with first and second projections of the EPL respectively positioned in the first and second grooves. A clip is connected to the channel member and is adapted for releasable connection to a wide variety of different retail shelf fixtures. The clip is defined by a base member and a back member interconnected to define an L-shaped cross-sectional shape, and the clip is further defined by a connecting arm that has a first end connected to the clip base member and a second end connected to the channel member. The connecting arm and the clip back member define a slot therebetween that receives and retains a projecting edge of an associated retail shelf.

In accordance with another aspect of the present invention, the channel member includes an adhesive mounting portion rather than a clip connected thereto. The mounting portion is adapted for adhesive securement to a surface of an associated retail shelf. An adapter is optionally provided for connection to a wire basket or similar retail fixture that does not present a surface for adhesive connection of the EPL holder thereto. In such case, the EPL holder is adhesively connected to a surface of the adapter, and the adapter is connected to the retail shelf, a wire basket, or other retail fixture by way of a clip portion.

In accordance with another aspect of the present invention, a transparent viewing lens is provided and placed in selective covering relation with an EPL positioned in the channel. The lens can be removably connected to the channel member or pivotably connected to the EPL holder and adapted for selective movement between an opened and closed position.

One advantage of the present invention is the provision of a holder for an electronic price label which is sturdy, durable, and cost-effective to manufacture.

Another advantage of the invention is the provision of a holder for an electronic price label which is adapted for secure, selective attachment to a wide variety of different retail shelving types.

Still another advantage of the present invention is found in the provision of a holder for an electronic price label which, when installed on a shelf, deflects outwardly away from the shelf to absorb impact upon being inadvertently contacted.

A further advantage of the present invention is the provision of a holder for an electronic price label wherein the holder is provided in one of a plurality of different configurations, each of which supports an electronic price label at a desired viewing angle relative to an associated shelf so that the supported electronic price label may be viewed at an optimal viewing angle for a given shelf height.

A still further advantage of the present invention is the provision of a holder for an electronic price label which includes a clear, protective viewing lens selectively secured thereto in a secure and convenient manner.

A yet further advantage of the invention is a provision of a holder for an electronic price label which includes a clip adapted for selective attachment of advertising or other materials thereto.

Another advantage of the present invention is the provision of a holder for an electronic price label wherein the protective lens portion thereof is adapted to selectively receive and retain associated tags, cards, or like material to be viewed in association with the information displayed on the electronic price label.

Still other benefits and advantages of the present invention will become apparent to those of ordinary skill in the art upon a reading and understanding of the following specification.

BRIEF DESCRIPTION OF THE DRAWINGS

The invention may take physical form in certain parts and arrangements of parts, several preferred embodiments of which are described in the specification and illustrated in the accompanying drawings which form a part hereof and wherein.

DETAILED DESCRIPTION OF THE INVENTION

Figure 1A:
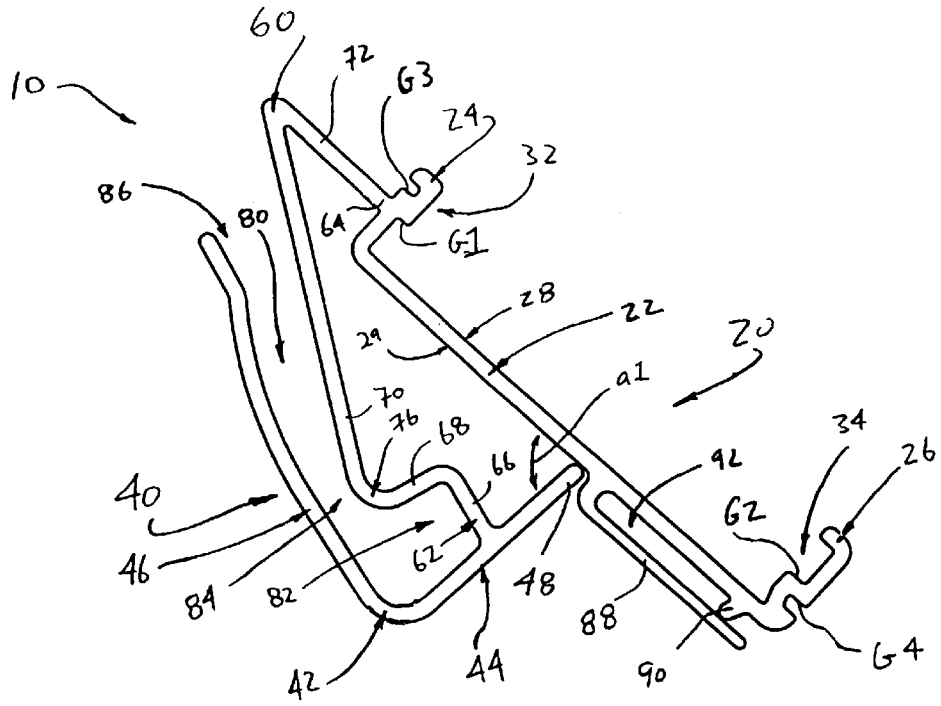
FIG. 1A is a side elevational view of a holder for a first type of electronic price label (EPL) formed in accordance with a first embodiment of the present invention.

With reference now to FIG. 1A a holder for an electronic price label (EPL) or the like is illustrated at 10. The holder 10 is formed in accordance with the present invention from polyvinyl chloride plastic or any other suitable plastic by extrusion, molding, or any suitable plastic forming technique. Preferably, the holder 10 is an extrusion having the profile as shown in FIG. 1.

Figure 1B:
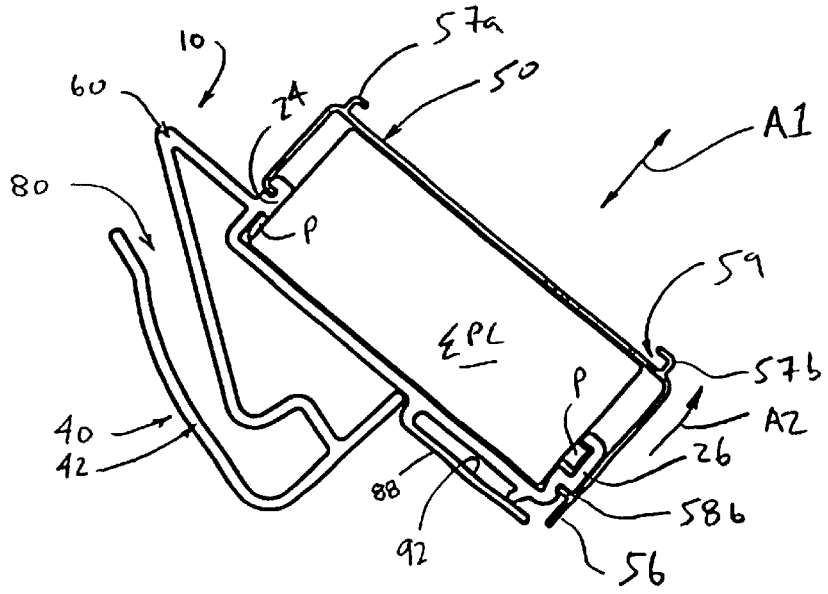
FIG. 1B is a reduced side elevational view of the holder of FIG. 1A as used to secure and associate EPL in an operative position and including an associated protective viewing lens positioned in covering relation with the EPL.

The holder 10 includes a base channel 20 having an overall C-shape conformation to slidably accommodate and frictionally retain an associated electronic price label (EPL) as seen in FIG. 1B. The C-channel is defined by a base wall 22 which is preferably planar, and top and bottom walls 24, 26, also referred to as first and second sidewalls, respectively. The top and bottom walls 24, 26 project outwardly from a front face 28 of the base wall 22, preferably a like distance and substantially perpendicular to the base wall 22. Thus, the top and bottom walls 24, 26 are arranged generally parallel to each other to accommodate an associated EPL in the recess defined therebetween and together with the base wall 22.

The opposed, inward faces 32, 34 of the top and bottom walls 24, 26, respectively, include grooves G1, G2 which accommodate projections P extending outwardly from the associated EPL positioned in the C-channel 20. This construction allows an associated EPL to be inserted and removed from the recess defined in the C-channel 20 by sliding and/or by movement of the EPL in a direction toward and away from the base wall 22 (as indicated by the arrow A1).

The holder 10 further comprises a clip portion 40 connected to the C-channel 20 by way of the top wall 24. The clip portion 40 is adapted to secure the holder 10 to an associated shelf S1–S5 as seen in FIGS. 3A–3E (the shelves S1–S5 generally referred to herein as shelves S). More particularly, the shelf attachment clip portion 40 comprises an L-shaped resilient member 42 having a base 44 and an upwardly projecting back portion 46.

The L-shaped clip 40 and the C-channel 20 are resiliently interconnected by way of a connecting arm 60. The arm 60 comprises a first end 62 connected to the base 44 of the L-shaped member 42 and a second end 64 connected to the top wall 24 of the C-channel 20 so that the arm 60 is at least partially positioned between the back portion 46 of the L-shaped clip 40 and the C-channel 20.

More particularly, the connecting arm 60 includes a first segment 66 projecting upwardly from the base member 44 of the L-shaped clip 40 in the same general direction as the upwardly projecting back portion 46 of the L-shaped clip. A second segment 68 of the connecting arm 60 extends toward the back portion 46 of the L-shaped clip 40, and a third segment 70 once again extends upwardly away from the base 44 of the clip 40. Finally, a fourth segment 72 connects the arm 60 to the top wall 24 of the C-channel 20. It can be seen that the connecting arm 60 is thus formed with an L-shaped bend 76 which protrudes toward the back portion 46 of the L-shaped clip 40. The L-shaped clip portion 40 and the connecting arm 60 thus define an upwardly open slot or channel 80 therebetween. The innermost closed end 82 of the slot 80 is enlarged.

The bend 76 of the connecting arm 60 and the back portion 46 of the clip 40 define therebetween a restricted portion 84 of the slot 80. The open end or mouth 86 of the slot 80 is preferably defined between the connecting arm 60 and an uppermost portion of the L-shaped clip back 46 which diverges from the connecting arm 60 so as to facilitate insertion of a shelf S therein for attachment of the holder 10 thereto. Therefore, the slot 80 is also defined with an overall L-shaped configuration.

A mounting angle al is defined between the L-shaped clip base wall 44 and the C-channel base wall 22 by abutment of a rear face 29 of the base wall 22 with an innermost tip 48 of the L-shaped clip 40 so that the C-channel 20 is rearwardly inclined relative to vertical by a select angle (approximately 45°) when in its operative position. The tip 48 is not connected to the base wall 22. This facilitates extrusion of the holder and allows for limited movement of the C-channel 20 away from the clip portion 40 as allowed by the resilience of the connecting arm 60 (as indicated by the arrow A2) to absorb and accommodate shocks by a shopper removing items from the associated retail shelf S (FIGS. 3A–3E) to which the holder 10 is attached or the shelf beneath the one to which the holder is attached. Those of ordinary skill in the art will recognize that the angle al may be varied to define different viewing angles of the C-channel relative to a vertical plane.

A resilient finger 88 projects from the rear face 29 of the base wall 22 and extends generally parallel to the base wall 22 in a direction toward the second side wall 26. The finger contacts a nib 90 projecting from the rear face 29 in the region of the second sidewall 26 so that a closed slot 92 is defined between the finger 88 and the rear face 29. An advertising flyer or the like (not illustrated) is selectively secured in the slot 92 by insertion of same between the finger 88 and the nib 90 where it is frictionally or otherwise retained.

The holder 10, due to its rearward inclination relative to vertical, is particularly adapted for a connection to an associated shelf S at a level below that of a viewer's eye level. Of course, those of ordinary skill in the art will recognize that the C-channel 20 can be arranged at any other wide variety of other desired angles a relative to the clip portion 40 so that the C-channel 20 defines other viewing angles relative to vertical without departing from the overall scope and intent of the present invention.

Figure 2A:
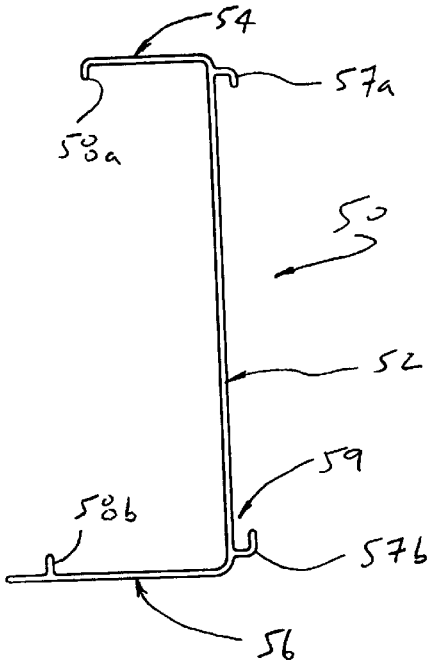
FIGS. 2A–2C are respective side elevational views of first, second, and third types of protective viewing lenses formed in accordance with the present invention.

With reference now also to FIG. 2A, a protective viewing lens 50 formed in accordance with the present invention is illustrated. The lens 50 is made from clear polyvinyl chloride or other clear plastic material, preferably extruded with the illustrated profile. More particularly, the lens 50 comprises a planar viewing wall 52, a first or upper sidewall 54, and a second or lower sidewall 56. First and second ribs 58*a*,58*b* project inwardly toward each other from the sidewalls 54, 56, respectively. As illustrated in FIG. 1B, the lens 50 is adapted for placement in covering relation with respect to the EPL secured to the C-channel 20 of the holder 10. When the lens 50 is so positioned, the ribs 58*a*, 58*b* are received in grooves G3, G4, formed in the outwardly facing surfaces of the holder sidewalls 24, 26, respectively. The receipt of the ribs 58*a*,58*b* in the grooves G3, G4 fixedly secures the lens 50 in its operative position relative to the holder 10.

The lens 50 also includes first and second L-shaped fingers 57*a*, 57*b* which project outwardly from the viewing wall 52 in a direction opposite the lens sidewalls 54, 56. The L-shaped fingers are arranged to define therebetween a slot 59 for receipt of printed matter or the like to be viewed in association with the price and other information displayed by the associated EPL.

With reference now to FIGS. 3A–3E, the holder 10, including an associated EPL and lens 50, are illustrated as being selectively secured to an associated retail shelf S1–S5, respectively (the shelves S1–S5 are each generally identified by the reference letter S). The illustrated shelves S1–S5 are so of the more commonly encountered types and the holder 10 is adapted for selective attachment thereto without use of separate hardware, adapters, or the like. More particularly, the illustrated shelves are known as Handy (S1), Streater (S2), Madix (S3), Kent (S4), and Lozier (S5). Of course, a holder formed in accordance with the present invention is also adapted to be releasably secured to other types of shelving, and the invention is not to be construes as being limited for use in association with any particular brand or type of shelving. As is apparent from the Figures, the holder 10 is adapted for selective, secure attachment to each type of shelf S1–S5. More particularly, each type of shelf S1–S5 includes a mounting flange F which is slidably received in the holder slot 80. Each type of shelf S1–S5 includes a projecting rolled edge E which provides the shelf with an L-shaped distal end. The L-shaped slot 80 of the holder 10 is well-suited to accommodate the mounting flange F of each type of shelf S1–S5 so that the holder 10 is effectively and conveniently secured in its operative position.

Figure 4:
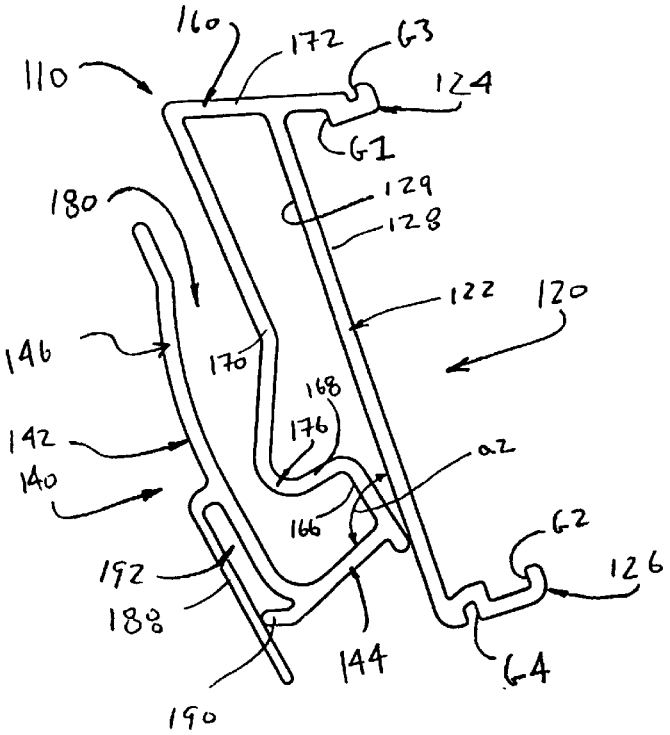
FIG. 4 is a side elevational view of a holder for the first type of EPL formed in accordance with a second embodiment of the present invention.
Figure 5:
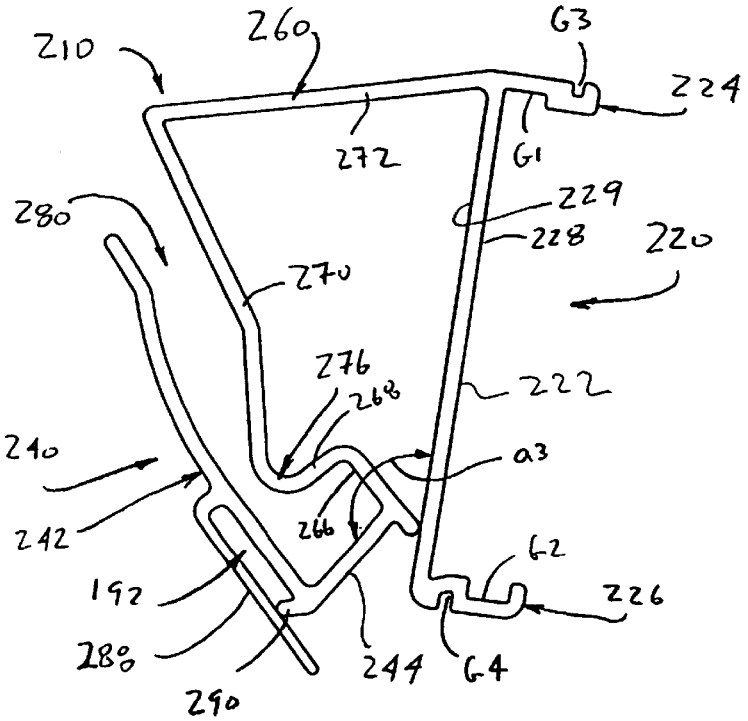
FIG. 5 is a side elevational view of a holder for the first type of EPL formed in accordance with a third embodiment of the present invention.

Referring now to FIGS. 4 and 5, holders 110 and 210 are illustrated. Except as shown and described herein, the holders 110, 210 are the same as the holder 10. Accordingly, like components of the holder 110, 210 relative to the holder 10 are identified with like reference numerals which are 100 and 200 greater than those used with respect to the holder 10, respectively. New components are identified with new reference numerals and/or letters.

The holder 110 includes a C-channel 120 and an L-shaped clip portion 140 which are interconnected by a connecting arm 160. The C-channel 120 and clip portion 140 are the same as the C-channel 20 and clip portion 40. However, the C-channel 120 and clip portion 140 are interconnected in such a manner that a mounting angle a2 is defined between the base 144 of the L-shaped clip member 142 and the rear face 129 of the C-channel 120. The angle a2 is greater than the angle al defined by the holder 10. In this manner, the C-channel is still rearwardly inclined in relation to vertical (approximately 15°) when the holder 110 is placed in its operative position connected to a shelf S. The holder 110 includes a flexible finger 188 and projecting nib 190 which cooperate to hold printed matter in the same manner as described above in relation to the finger 88 and nip 90. However, the finger 188 and nib 190 project from the back 146 of the L-shaped clip member rather than from the rear wall 129 of the C-channel 120.

With reference to FIG. 5, the holder 210 is substantially similar to the holder 110, except that the mounting angle a3 defined between the base 244 of the L-shaped member 242 and the rear face 229 of the C-channel 220 is even larger than the angle a2 of the holder 110. The length of the segment 272 of the connecting arm 260 is correspondingly increased in relation to the segment 172 of the arm 160 of the holder 110. These features provide the holder with a forwardly inclined C-channel relative to vertical (approximately 15°) when the holder 210 is operatively connected to an associated shelf S.

Figure 2B:
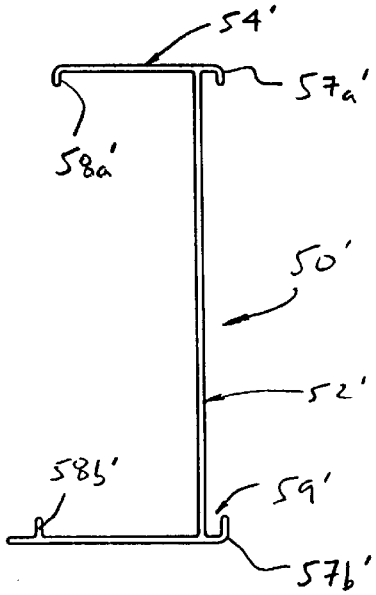
Figure 6A:
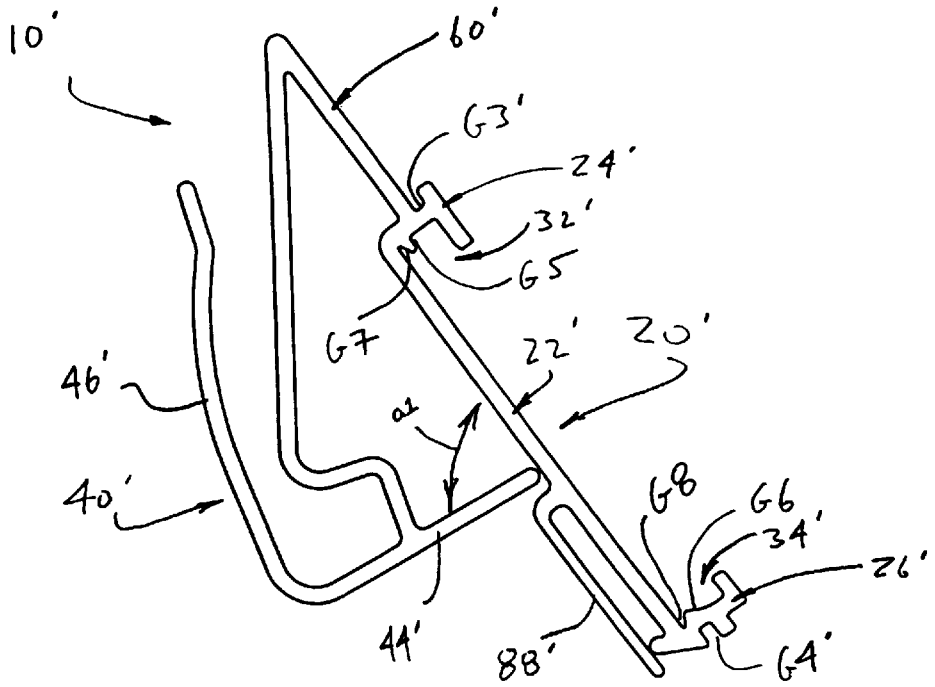
FIG. 6A is a side elevational view of a holder for a second type of EPL formed in accordance with the present invention.
Figure 6B:
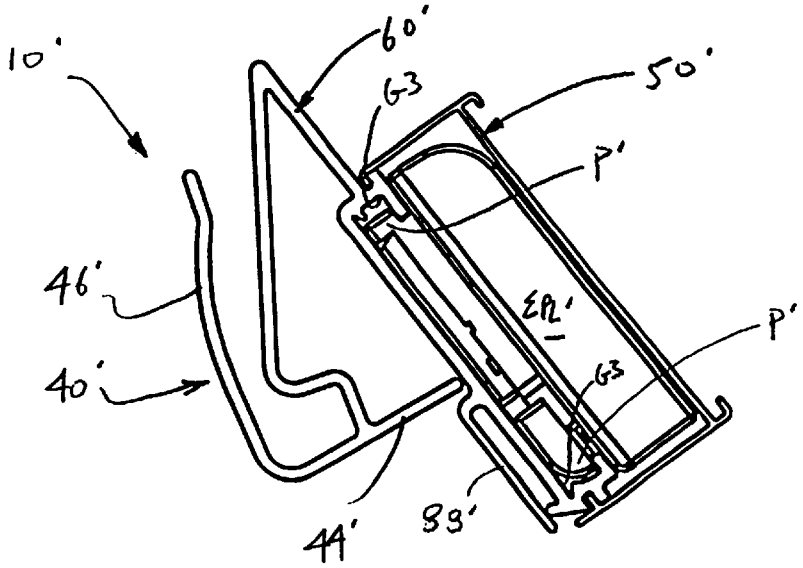
FIG. 6B is a reduced side elevational view of the holder of FIG. 6A as used to secure an associated second-type EPL in an operative position and including an associated protective viewing lens placed in covering relation with the second-type EPL.

FIGS. 6A and 6B illustrate another holder 10' formed in accordance with the present invention. The holder 10' is identical to the holder 10, except that it is adapted to receive and retain a second type of electronic price label EPL' which includes projections P'. Therefore, the holder 10' includes a C-channel 20' with top and bottom end walls 24', 26'. The endwalls 24', 26' include inwardly opening grooves G5, G6 formed therein which are adapted to slidably or otherwise receive the projections P' of the second-type electronic price label EPL'. Grooves G7, G8 defined respectively in the inner faces 32', 34' cooperate to define a slot adjacent the base wall 22' adapted to receive and retain a decorative strip, advertising, or other printed matter behind and/or adjacent the electronic price label EPL' secured to the holder 10'. A viewing lens 50'(see also FIG. 2B) is placed in selective covering relation with the electronic price label EPL' and connects to the holder 10' in the same manner that the lens 50 connects to the holder 10, i.e., through cooperation of the ribs 58*a* ', 58*b* ' and grooves G3', G4', respectively. However, the lens 50' is dimensioned differently than the lens 50 to account for the dimensional differences between the holders 10, 10'.

Figure 7:
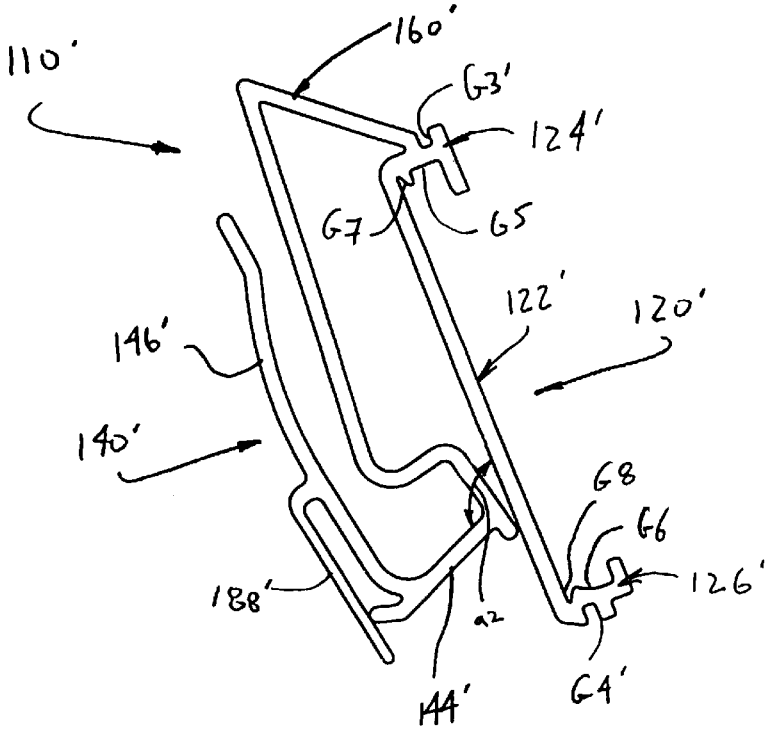
FIG. 7 is a side elevational view of a holder for the second-type EPL formed in accordance with another embodiment of-the present invention.
Figure 8:
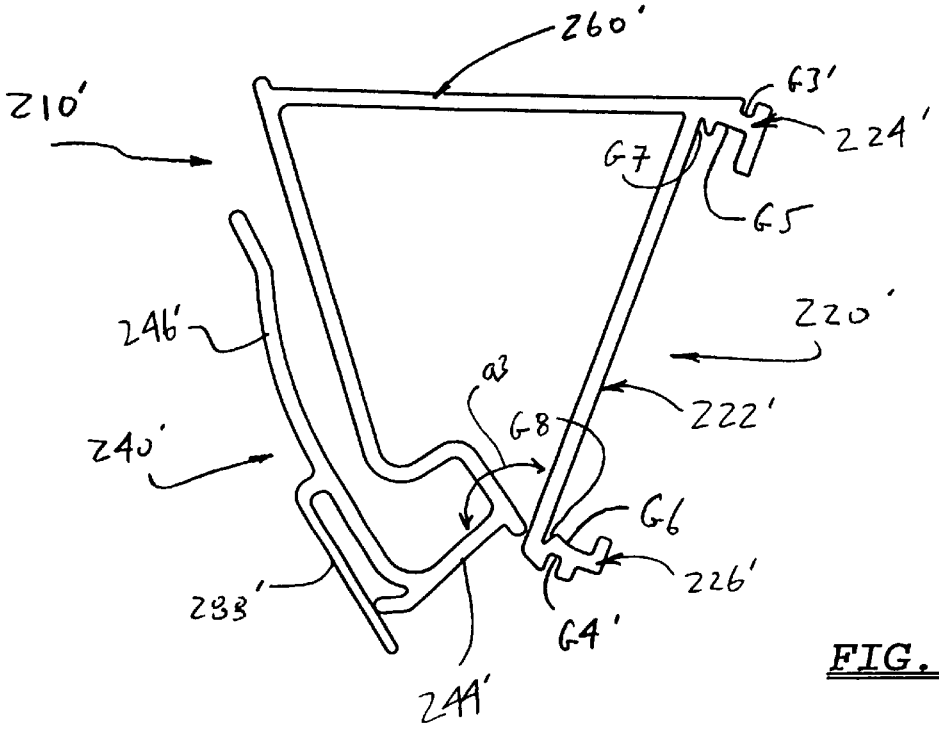
FIG. 8 is a side elevational view of a holder for the second-type EPL formed in accordance with still another embodiment of the present invention.

Likewise, the holders 110' and 210' illustrated in FIGS. 7 and 8 are respectively identical to the holders 110, 210, except for use of C-channels 120', 220' conformed in the same manner as the C-channel 20' to receive and retain and associated second-type electronic price label EPL'.

Figure 9B:
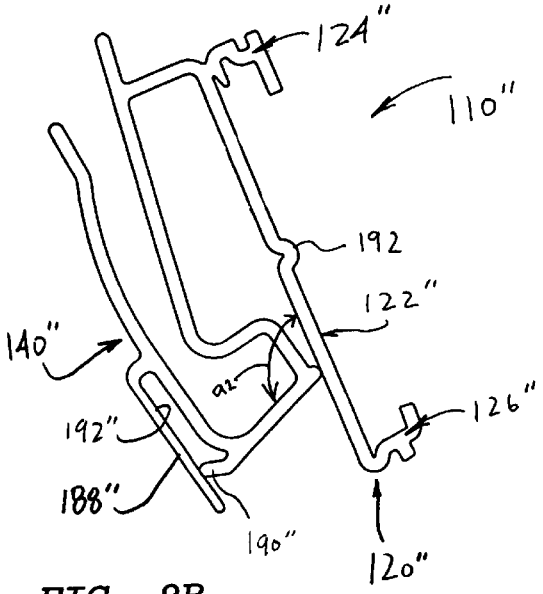
FIG. 9B is a side elevational view of an EPL holder similar to that illustrated in FIG. 9A, but conformed with a different mounting angle.
Figure 9A:
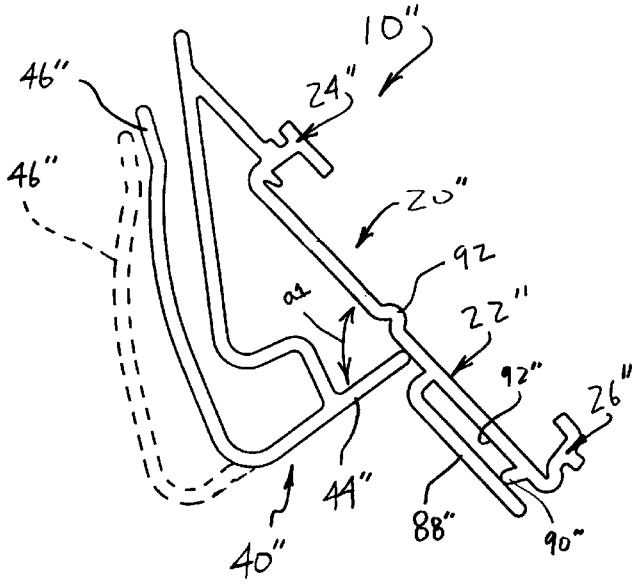
FIG. 9A is a side elevational view of a modified version of the EPL holder illustrated in FIG. 6A.
Figure 9C:
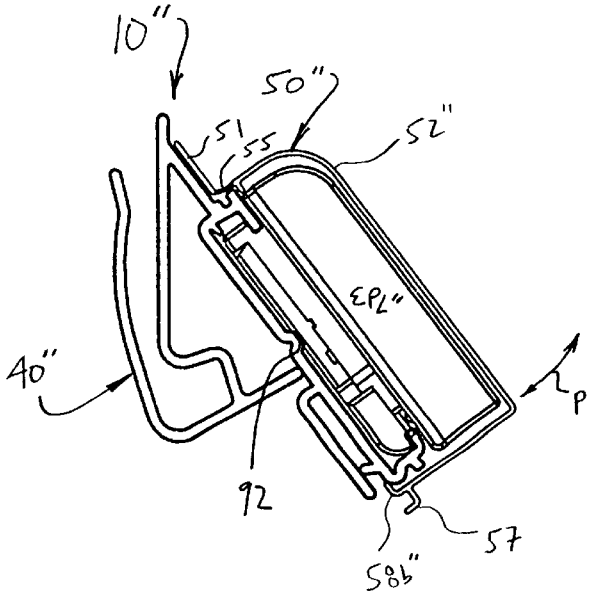
FIG. 9C illustrates the holder of FIG. 9A and an associated EPL held thereby and including the viewing lens of FIG. 2C connected thereto.

The electronic price label holder 10' illustrated in FIG. 9A is similar to the holder 10' shown in FIG. 6A and, thus, like components relative to the holder 10' are identified with like reference numerals and letters including a double-primed (' ) suffix. New components are identified with new reference numerals and letters. Unlike the holder 10', the base channel 20" of the holder 10" includes a longitudinally extending dimple or rib 92 that projects outwardly from the base wall 22", preferably centrally between and extending parallel to the upper and lower sidewalls 24", 26". The rib 92 projects outwardly from the base wall 22" a sufficient distance so that it will firmly and frictionally engage a rear surface of an associated electronic price label EPL" held between the upper and lower sidewalls 24", 26" as illustrated in FIG. 9C. The rib 92 thus provides a means for inhibiting movement of the associated electronic price label EPL" in a plane parallel to the base wall 22" under side-loading conditions owing to the fact that the associated electronic price label is held by three-point contact with the holder 10". As indicated in broken lines at 46" the length of the base portion 44" of the clip 40" can be lengthened as desired so that the clip 40" is adapted for connection to any type of shelf S with a projecting edge E, including STORFLEXT™brand shelving.

The electronic price label holder 110" illustrated in FIG. 9B is similar to the holder 110' shown in FIG. 7 and, thus, like components relative to the holder 110' are identified with like reference numerals and letters including a double-primed (") suffix, and new components are identified with new reference numerals and letters. Like the holder 10", the holder 110" also includes a longitudinally extending dimple or rib 192 that projects outwardly from the base wall 122" of the base channel 120", preferably centrally between and extending parallel to the upper and lower sidewalls 124", 126". The rib 192 projects outwardly from the base wall 122" a sufficient distance so that it will firmly and frictionally engage a rear surface of an associated electronic price label EPL" held between the upper and lower sidewalls 124", 126". The holder 110" is identical to the holder 10" illustrated in FIG. 9A but defines a different mounting angle a2 rather than the smaller mounting angle al defined by the holder 10".

Figure 2C:
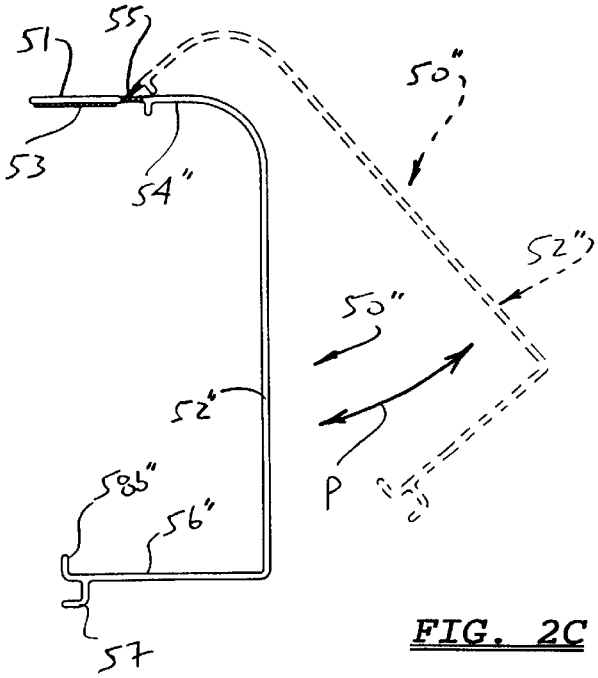
Figure 3A:
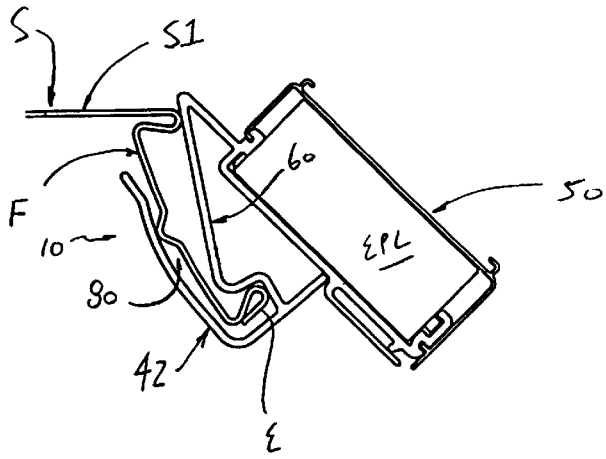
FIGS. 3A–3E are side elevational views of the holder, EPL, and protective viewing lens of FIG. 1B as selectively connected to five different types of associated retail shelving in an operative position in accordance with the present invention.
Figure 3B:
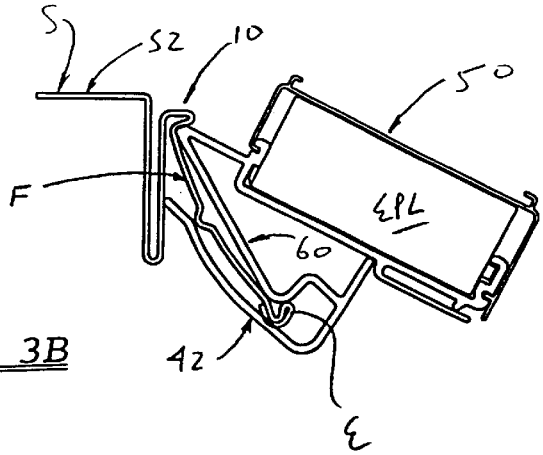
Figure 3C:
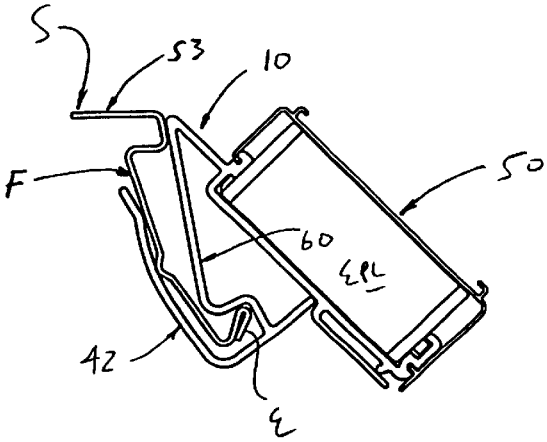
Figure 3D:
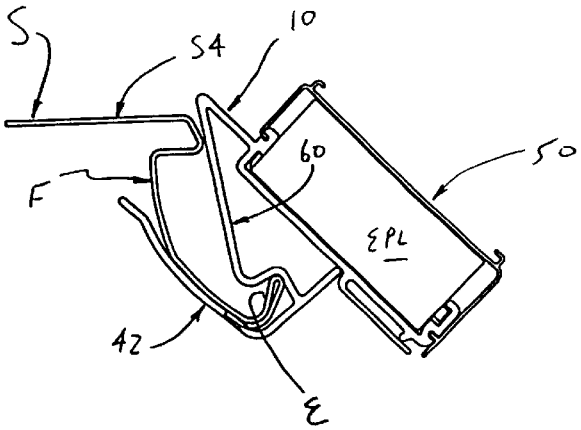
Figure 3E:
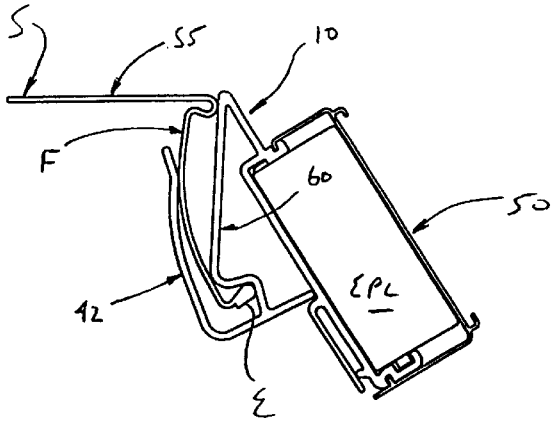

With particular reference now to FIGS. 2C and 9C, a lens 50" formed in accordance with a third embodiment of the present invention is illustrated. The lens 50" is preferably extruded from a transparent plastic material to have the profile illustrated in FIG. 2C. The lens 50" is similar to the lenses 50, 50' and like components relative to the lens 50 are identified with like reference numbers including a double-primed (") suffix. Unlike the lenses 50, 50', the lens 50" is not adapted to releasably engage an associated holder such as the holder 10" illustrated in FIG. 9C. Instead, the lens 50" comprises a mounting portion 51 that includes an adhesive 53 such as a pressure sensitive adhesive tape or the like on a face thereof. Thus, the mounting portion 51 is adapted for being fixedly secured to an associated holder, such as the holder 10" illustrated in FIG. 9C. The lens 50" also comprises a viewing wall 52" that is connected to the mounting portion 51 by way of a living hinge 55 that can be formed as a one-piece construction with the mounting portion 51 and viewing wall 52" or that can be provided by a length of tape of other material. The mounting portion 51 of the lens 50" is secured to the associated holder 10" in a position so that the viewing wall 52" is adapted for pivoting movement on an arc P between a-closed position (illustrated in solid lines in FIG. 2C) wherein the viewing wall is placed in covering relation with the associated electronic price label EPL" secured to the holder 10", and an open position (illustrated in broken lines in FIG. 2C) wherein the viewing wall moved away from the associated electronic price label EPL" allowing access to same. In the closed position as illustrated in FIG. 9C, the finger 58*b* " engages the sidewall 26" of the holder 10" so that the lens is resistant to movement from its closed position to its open position. Preferably, a rib 57 is provided an projects outwardly from the sidewall 56" of the lens 50" to facilitate manual grasping of the viewing wall 52" for purposes of moving same to its open position. Those of ordinary skill in the art will recognize that the adhesive 53 and the living hinge 55 cooperate to prevent spilled liquids from contacting the associated electronic price label EPL" held by the channel member 20".

Figure 10A:
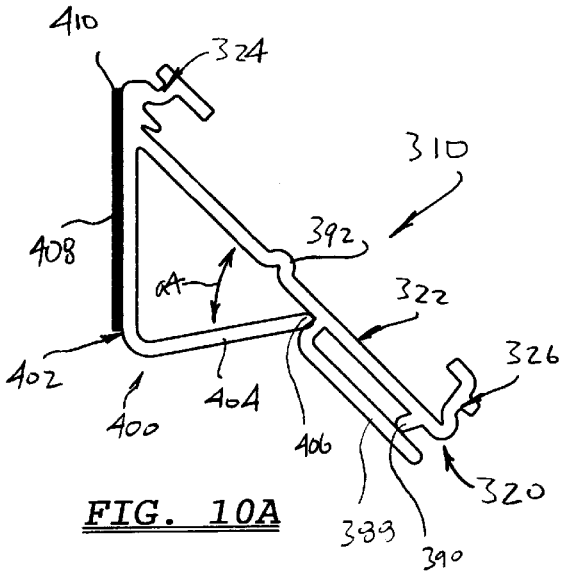
FIGS. 10A and 10B illustrate holders for an EPL formed in accordance with another embodiment of the present invention respectively formed to define different mounting angles.

With reference now to FIG. 10A, a holder 310 for an electronic price label formed in accordance with another embodiment of the present invention is illustrated. The holder 310 includes a base channel 320 that is identical to the base channel 20" of the holder 10" illustrated in FIG. 9A, and like components relative to the holder 10" are identified with like reference numbers that are 300 greater than the corresponding numbers used in FIG. 9A. However, unlike the holder 10", the holder 310 does not include a clip portion for direct attachment to a store shelf. Instead, the holder 310 comprises an L-shaped mounting base 400 defined by a back member 402 and a base member 404. The innermost end 406 of the base member 404 abuts or lies closely adjacent the base channel 320 but is not directly connected thereto. Thus, the base channel 320 is adapted for limited resilient movement away from the innermost end 406. On the other hand, the innermost end 406 limits movement of the base channel 320 toward the back member 402 of the mounting base 400. When the holder 310 is operatively connected to a store shelf or other fixture, is preferred that the back member 402 be disposed substantially vertically. The base channel 320 defines a mounting angle a4 with the base member 404 that controls the angle of an electronic price label held in the channel 320 relative to vertical.

Figure 10B:
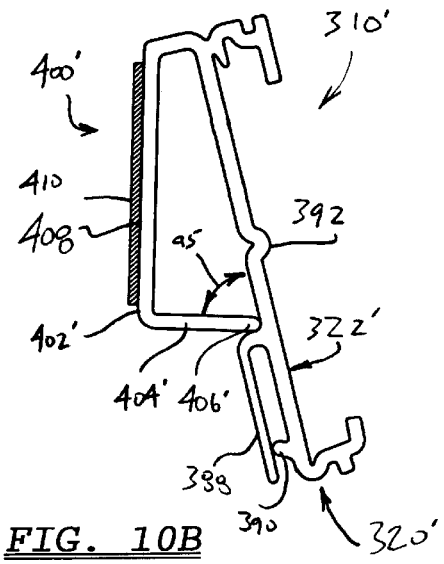

The holder 310' illustrated in FIG. 10B is identical to the holder 310 in all respects except that a different mounting angle a5 is defined between the base channel 320' and the mounting base 400'. Accordingly, like components relative to the holder 310 are identified with like reference numbers including a primed (') suffix.

Figure 11A:
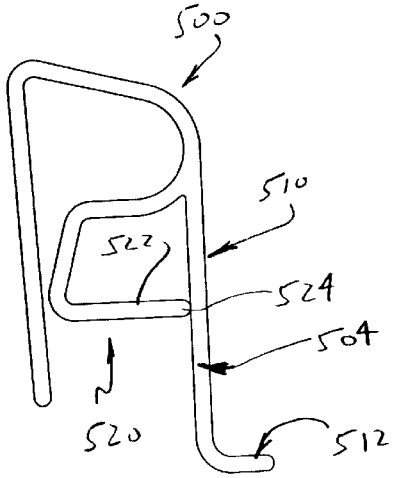
FIG. 11A is a side elevational view of an adapter that facilitates connection of the EPL holder of FIGS. 10A and 10B to a wire basket, wire shelf, or other non-planar retail fixture.
Figure 11B:
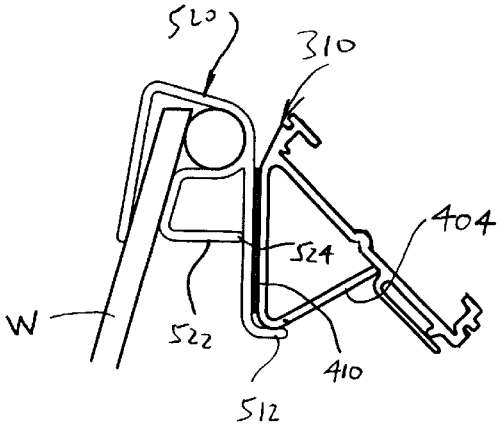
FIG. 11B illustrates the EPL holder of FIG. 10A operatively secured to an associated wire fixture using the adapter of FIG. 11A.

FIGS. 11A and 11B illustrate the extrusion profile of an adapter 500 that is used for connecting the holders 310, 310' to a wire fixture. The adapter 500 comprises a mounting portion 504 and a clip portion 520 connected to the mounting portion. The mounting portion 504 defines a planar face 510. The clip portion 520 is adapted for releasable connection to a wire basket, a wire rack, or other type of retail wire fixture W as illustrated in FIG. 11B so that the planar face 510 is arranged vertically. This face 510 presents a convenient and effective surface for connection of the holder 310, 310' to the adapter 500 by way of the adhesive 410. Preferably, the mounting portion 504 of the adapter 500 also defines a foot 512 projecting outwardly from the planar face 510. The foot 512 provides additional support for the mounting portion 400 of the holder 310, 310' adhesively secured to the adapter.

With continuing reference to FIG. 11B, when the adapter 500 is connected to an associated wire fixture W, a base member 522 is positioned between the wire fixture W and the mounting portion 504 of the adapted 500. The base member 522 includes an innermost tip 524 that abuts but is not directly connected to the mounting portion 504 and, thus, the mounting portion 504 is adapted for limited resilient movement away from the tip 524. Of course, the base member 522 limits movement of the mounting portion 504 toward the associated wire fixture W.

Figure 12A:
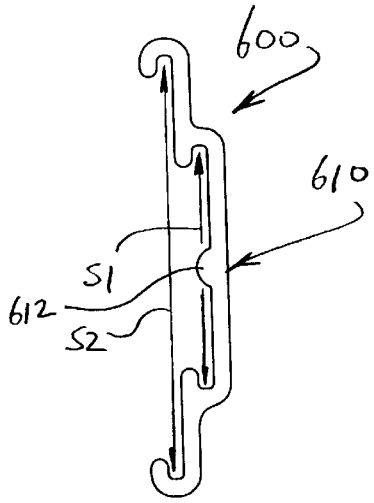
FIG. 12A is a side elevational view of an adapter that facilitates connection of the EPL holder of FIGS. 10A and 10B to a projecting peg; and, FIGS. 12B and 12C illustrate the adapter of FIG. 12A operatively secured to first and second types of associated pegs, respectively.

FIG. 12A illustrates the extrusion profile of an adapter 600 that facilitates operative connection of the holders 310, 310' to a peg projecting outwardly from a pegboard of other surface. The adapter 600 defines an outwardly facing planar mounting surface 610 that is preferably arranged vertically when the adapter is connected to an associated projecting peg. The face 610 thus provides a convenient and effective mounting location for connecting the holders 310, 310' to the adapter 600 by way of the adhesive 410.

Figure 12B:
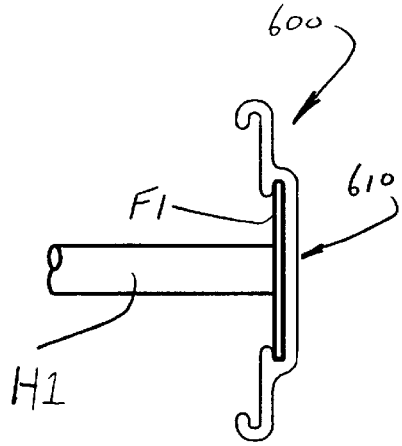
Figure 12C:
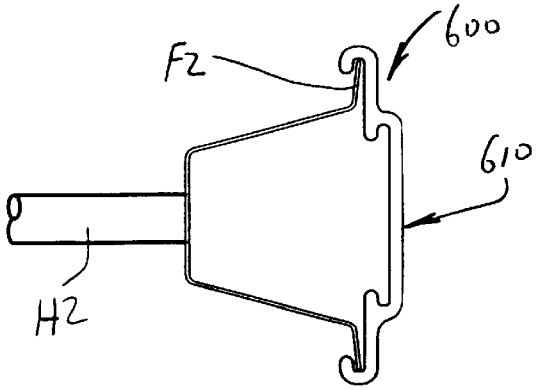

The adapter 600 also defines a mounting portion comprises a first slot S1 having a first height, and a second slot S2 having a second height. With reference to FIGS. 12B and 12C, the slots S1, S2 are adapted for respective sliding receipt of differently sized flanges F1, F2 connected to first and second projecting pegs H1, H2. A ridge 612 is preferably provided in at least the first slot S1 to frictionally engage an associated flange F1 inserted therein.

Those of ordinary skill in the art will recognize that the electronic price label holders and adapters described herein are all preferably extruded with the respective illustrated profiles. Thus, each adapter and holder can have any desired length along its longitudinal axis, i.e., the axis of extrusion. Furthermore, given that the illustrated adapters and holders are extrusions, all portions shown in each profile are preferably continuous and uninterrupted along the length of the extrusion.

The invention has been described with reference to preferred embodiments. Of course, modifications and alterations will occur to others upon a reading and understanding the preceding specification. It is intended that the invention be construed as including all such modifications and alterations.

Having thus described the preferred embodiments, the invention is now claimed to be:

1. A holder for an electronic price label, said holder comprising:

a channel member defined by a base wall and first and second spaced-apart sidewalls that project outwardly from opposite ends of the base wall with respective first and second inner faces arranged in opposed facing relation with each other so that said base wall and said first and second sidewalls define a recess with a C-shaped cross-sectional shape for selectively accommodating an associated electronic price label;

a clip connected to said channel member, said clip comprising a base member and a back member interconnected to define an L-shaped cross-sectional shape, said clip further comprising a connecting arm having a first end connected to one of said clip base member and said back member and a second end connected to said channel member, said connecting arm and said clip together defining an L-shaped slot therebetween, said slot being spaced from said channel member and adapted to receive and retain therein a projecting portion of an associated retail shelf.

2. A holder for an electronic price label, said holder comprising:

a channel member defined by a base wall and first and second spaced-apart sidewalls that project outwardly from opposite ends of the base wall with respective first and second inner faces arranged in opposed facing relation with each other so that said base wall and said first and second sidewalls define a recess with a C-shaped cross-sectional shape for selectively accommodating an associated electronic price label;

a clip connected to said channel member, said clip comprising a base member and a back member interconnected to define an L-shaped cross-sectional shape, said clip further comprising a connecting arm having a first end connected to one of said clip base member and said back member and a second end connected to said channel member, said connecting arm and said clip together defining an L-shaped slot therebetween, said slot adapted to receive and retain therein a projecting portion of an associated retail shelf; and, said second end of said connecting arm is connected to said channel member adjacent said first sidewall.

3. The electronic price label holder as set forth in claim 2, wherein said first end of said connecting arm is connected to said clip base member intermediate said clip back member and an innermost tip of said clip base member.

4. The electronic price label holder as set forth in claim 3, wherein said connecting arm is defined by a first segment connected to said clip base member and extending away therefrom, a second segment connected to the first segment and extending toward the clip back member, a third segment connected to the second segment and extending away from the clip base member, and a fourth segment connected to both the third segment and the channel member.

5. The electronic price label holder as set forth in claim 1, further comprising:

a resilient finger and a nib connected to one of said channel member and said clip and defining a space between said finger, said nib, and said one of said channel member and said clip for selective insertion and frictional retention of printed matter.

6. The electronic price label holder as set forth in claim 1, wherein said base wall of said channel is planar entirely between said first and second sidewalls of said channel member.

7. The electronic price label holder as set forth in claim 1, wherein said first and second walls of said channel member respectively include third and fourth grooves defined in said inner faces, said third and fourth grooves together defining a slot for selective receipt of decorative and informational printed matter.

8. The electronic price label holder as set forth in claim 1, wherein said channel member and said clip are defined together as a one-piece extrusion.

9. A holder for an electronic price label, said holder comprising:

a channel member defined by a base wall and first and second spaced-apart sidewalls that project outwardly from opposite ends of the base wall with respective first and second inner faces arranged in opposed facing relation with each other so that said base wall and said first and second sidewalls define a recess with a C-shaped cross-sectional shape for selectively accommodating an associated electronic price label;

a clip connected to said channel member, said clip comprising a base member and a back member interconnected to define an approximately L-shaped cross-sectional shape, said clip further comprising a connecting arm having a first portion connected to one of said clip base member and said back member and a second portion connected to said channel member, said clip being adapted to receive and retain therein a projecting portion of an associated retail shelf; and, a transparent lens selectively positioned in covering spaced relation with said base wall of said channel.

10. The electronic price label holder as set forth in claim 9, wherein said lens includes a viewing wall, and first and second sidewalls projecting outwardly from said viewing wall, said first and second sidewalls of said lens arranged in opposed facing relation to each other and wherein at least one of said first and second sidewalls is adapted for selective releasable connection to an adjacent one of said first and second sidewalls of said channel.

11. The electronic price label holder as set forth in claim 10, wherein said first and second sidewalls of said channel member each respectively define first and second outer faces respectively opposite said first and second inner faces, wherein said first and second outer faces each define a lens retention groove, and wherein said first and second sidewalls of said lens each define a projection adapted for selective receipt in said lens retention grooves, respectively.

12. The electronic price label holder as set forth in claim 9, wherein said lens includes a viewing wall and at least one finger projecting away from said viewing wall.

13. The electronic price label holder as set forth in claim 6, wherein said lens comprises:

a mounting portion secured to one of said channel member and said clip;

a transparent viewing wall; and, a hinge interconnecting said mounting portion and said transparent viewing wall, said transparent viewing wall adapted for movement between an open position, wherein said transparent viewing wall extends away from said base wall of said channel member, and a closed position, wherein said transparent viewing wall is placed in covering spaced relation with said recess.

14. The electronic price label holder as set forth in claim 13, wherein said hinge of said lens is a living hinge.

15. A holder for an electronic price label, said holder comprising:

a channel member defined by a base wall and first and second spaced-apart sidewalls that project outwardly from opposite ends of the base wall with respective first and second inner faces arranged in opposed facing relation with each other so that said base wall and said first and second sidewalls define a recess with a C-shaped cross-sectional shape for selectively accommodating an associated electronic price label;

a clip connected to said channel member, said clip comprising a base member and a back member interconnected to define an approximately L-shaped cross-sectional shape, said clip further comprising a connecting arm having a first portion connected to one of said clip base member and said back member and a second portion connected to said channel member, said connecting arm and said clip together defining an approximately L-shaped slot therebetween, said slot adapted to receive and retain therein a projecting portion of an associated retail shelf; and, said base wall of said channel member comprises a protrusion that projects into said recess, said protrusion being adapted to abut a rear surface of an associated electronic price label positioned in said recess.

16. An apparatus for holding an associated electronic price label, said holding apparatus comprising:

a channel member defined by a base wall and first and second spaced-apart sidewalls that project outwardly from opposite ends of the base wall with respective first and second inner faces arranged in opposed facing relation with each other so that said base wall and said first and second sidewalls define a recess with a C-shaped cross-sectional shape, said first and second inner faces each defining a groove that extends parallel to said base wall whereby an associated electronic price label is adapted for receipt in said recess between said first and second sidewalls and adjacent said base wall with first and second projections of said associated electronic price label respectively positioned in said first and second grooves; and, a mounting portion including an L-shaped clip member connected to said channel member by a connecting element, said connecting element having a first end connected to said clip member and a second end connected to said channel member, an upwardly opening slot spaced from said channel member, being defined between said L-shaped clip member and said connecting member for accommodating a depending portion of an associated retail fixture.

17. A holder for an electronic price label, said holder comprising:

a channel member defined by a base wall and first and second spaced-apart sidewalls that project outwardly from opposite ends of the base wall with respective first and second inner faces arranged in opposed facing relation with each other so that said base wall and said first and second sidewalls define a recess with a C-shaped cross-section; and, a clip connected to said channel member, said clip comprising a base member and a back member interconnected to define an approximately L-shaped cross-sectional shape, said clip further comprising a connecting arm having a first portion connected to said clip and a second portion connected to said channel member, said connecting arm and said clip together defining a slot spaced from said channel member and adapted to receive and retain therein a portion of an associated retail shelf.

18. The electronic price label holder as set forth in claim 17, wherein said connecting arm is defined by a first segment connected to said clip and a second segment connected to the first segment and extending away from said channel member.

19. An apparatus for holding an associated electronic price label, said holding apparatus comprising:

a channel member defined by a base wall and first and second spaced-apart sidewalls that project outwardly from opposite ends of the base wall with respective first and second inner faces arranged in opposed facing relation with each other so that said base wall and said first and second sidewalls define a recess with a C-shaped cross-sectional shape, said first and second inner faces each defining a groove that extends parallel to said base wall whereby an associated electronic price label is adapted for receipt in said recess between said first and second sidewalls and adjacent said base wall with first and second projections of said associated electronic price label respectively positioned in said first and second grooves;

a mounting portion including a clip member connected to said channel member by a connecting element, said connecting element having a first portion connected to said clip member and a second portion connected to said channel member, an upwardly opening slot being defined by said clip member for accommodating a depending portion of an associated retail fixture; and, a transparent lens selectively positioned in covering spaced relation with said base wall of said channel.

* * * * *